US011903502B2

(12) United States Patent
Wing

(10) Patent No.: US 11,903,502 B2
(45) Date of Patent: Feb. 20, 2024

(54) COMBINATION CAN INSULATOR AND SHOTGUNNING DEVICE

(71) Applicant: Miles Wing, Ashby, MN (US)

(72) Inventor: Miles Wing, Ashby, MN (US)

(73) Assignee: Miles Wing, Ashby, MN (US)

( * ) Notice: Subject to any disclaimer, the term of this patent is extended or adjusted under 35 U.S.C. 154(b) by 171 days.

(21) Appl. No.: 17/590,912

(22) Filed: Feb. 2, 2022

(65) Prior Publication Data

US 2023/0240461 A1 Aug. 3, 2023

(51) Int. Cl.
*A47G 23/02* (2006.01)
*B65D 81/38* (2006.01)

(52) U.S. Cl.
CPC ..... *A47G 23/0266* (2013.01); *B65D 81/3876* (2013.01)

(58) Field of Classification Search
CPC ..... A47G 23/0266; A47G 19/2222; A47G 21/18; A47G 21/184; B65D 81/3876; B65D 81/3879; B65D 81/3881; B65D 81/3883; B65D 81/3886; B65D 81/3888; B65D 81/389; B65D 81/3893; B65D 81/3895; B65D 81/3897
See application file for complete search history.

(56) References Cited

U.S. PATENT DOCUMENTS 5,964,382 A * 10/1999 Randal ..... B65D 47/06 222/481.5
9,788,574 B2 * 10/2017 Mullen ..... A24F 3/00
10,138,034 B2 * 11/2018 Brown ..... B65D 47/32
10,280,058 B1 5/2019 Pickett
RE48,512 E 4/2021 Stirbis
2005/0269336 A1 * 12/2005 Rockhill ..... A47G 19/2272 220/745
2009/0230141 A1 9/2009 Haney
2011/0233236 A1 * 9/2011 Brown ..... B65D 47/32 222/481.5
2019/0218087 A1 7/2019 Clark

FOREIGN PATENT DOCUMENTS

AU 2020100176 3/2020

OTHER PUBLICATIONS https://kongbeerbong.com/products/the-kong?currency=USD&variant=31874696577060&utm_medium=cpc&utm_source=google&utm_campaign=Google%20Shopping&gclid=CjwKCAjwhOyJBhA4EiwAEcJdcXrAkHN9d1MK9RxvKSLBN2hChLXQUB2t97XJmcjUsqlBiXur6Bih0xoCFeAQAvD_BwE.
https://www.amazon.com/Portable-Bottle-Detachable-Expandable-Funnel/dp/B0979139ST/ref=asc_df_B0979139ST/?tag=hyprod-20&linkCode=df0&hvadid=532660687583&hvpos=&hvnetw=g&hvrand=8680196988172251 62&hvpone=&hvptwo=&hvqmt=&hvdev=c&hvdvomdl=&hvlocint=&hvlocphy=9008305&hvtargid=pla-1395066424292&psc=1.

* cited by examiner

*Primary Examiner* — Javier A Pagan
(74) *Attorney, Agent, or Firm* — Edison Law Group

(57) ABSTRACT

A combination can insulating sleeve and shotgunning device are provided. The device and method of use allow for rapidly emptying the contents of a can. The insulating sleeve is substantially cylindrical and has a pair of cooperating openings formed therein. A first opening is formed in the bottom portion of the sleeve and functions as a ventilating port adapted to receive a straw. A tubular cavity formed in the sleeve allows for storage of the straw. A second opening is formed in the lower sidewall of the bottom portion of the sleeve and functions as a drinking hole. The sleeve is placed over the can in the well known manner for use as a cozy. The sleeve is placed over the mouth of the can for rapid emptying, with the straw inserted into the ventilating port, the (Continued)

straw serving to allow air to enter the can without impeding flow from the drinking hole.

4 Claims, 3 Drawing Sheets

COMBINATION CAN INSULATOR AND SHOTGUNNING DEVICE

1. FIELD OF THE INVENTION

The present invention relates generally to beverage containers. More particularly, the invention relates to an insulating sleeve for a can which can function as a shotgunning device.

BACKGROUND OF THE INVENTION

The term "shotgunning" is used to describe a process of drinking a beverage, usually beer, as quickly as possible from a can. Typically, a user will puncture the can sidewall to produce a drinking opening, open the top of the can to provide a ventilating hole or port, and then consume the contents rapidly as the extra ventilation hole permits rapid emptying of the can. This method and the devices based thereon have drawbacks. First, the contents from the can will spill if the sidewall opening is not properly done. Also, the hole created by the puncturing can be jagged and unsanitary. Finally, the device is only useful for shotgunning Accordingly, there have been numerous attempts to produce a device or method to allow for safely and easily shotgunning from a can. These devices are of varying complexity and effectiveness but all suffer from the drawback that they are not necessary unless a user wishes to drink rapidly or shotgun.

Can insulating sleeves are commonly used to keep the liquid contents of a can cool, especially when the can contains an alcoholic beverage or other beverage that is consumed slowly. The present invention takes advantage of the fact that the insulating sleeve or "cozy" is commonly used by providing a shotgunning device combined with a cozy.

SUMMARY OF THE INVENTION

A combination can insulating sleeve and shotgunning device are provided. The device and method of use allow for rapidly emptying the contents of a can. The insulating sleeve is substantially cylindrical and has a pair of cooperating openings formed therein. A first opening is formed in the bottom portion of the sleeve and functions as a ventilating port adapted to receive a straw. A tubular cavity formed in the sleeve allows for storage of the straw. A second opening is formed in the lower sidewall of the bottom portion of the sleeve and functions as a drinking hole. The sleeve is placed over the can in the well known manner for use as a cozy. The sleeve is placed over the mouth of the can for rapid emptying in accordance with the inventive method, with the straw inserted into the ventilating port, the straw serving to allow air to enter the can without impeding flow from the drinking hole.

It is a major object of the invention to provide an improved method and apparatus for rapidly emptying a container.

It is another object of the invention to provide an improved method and apparatus for rapid emptying of a beverage container which avoids the need to form a separate ventilating port.

It is another object of the invention to provide an improved method and apparatus for rapid emptying of a beverage container which is incorporated into an insulating sleeve.

DETAILED DESCRIPTION

Figure 1:
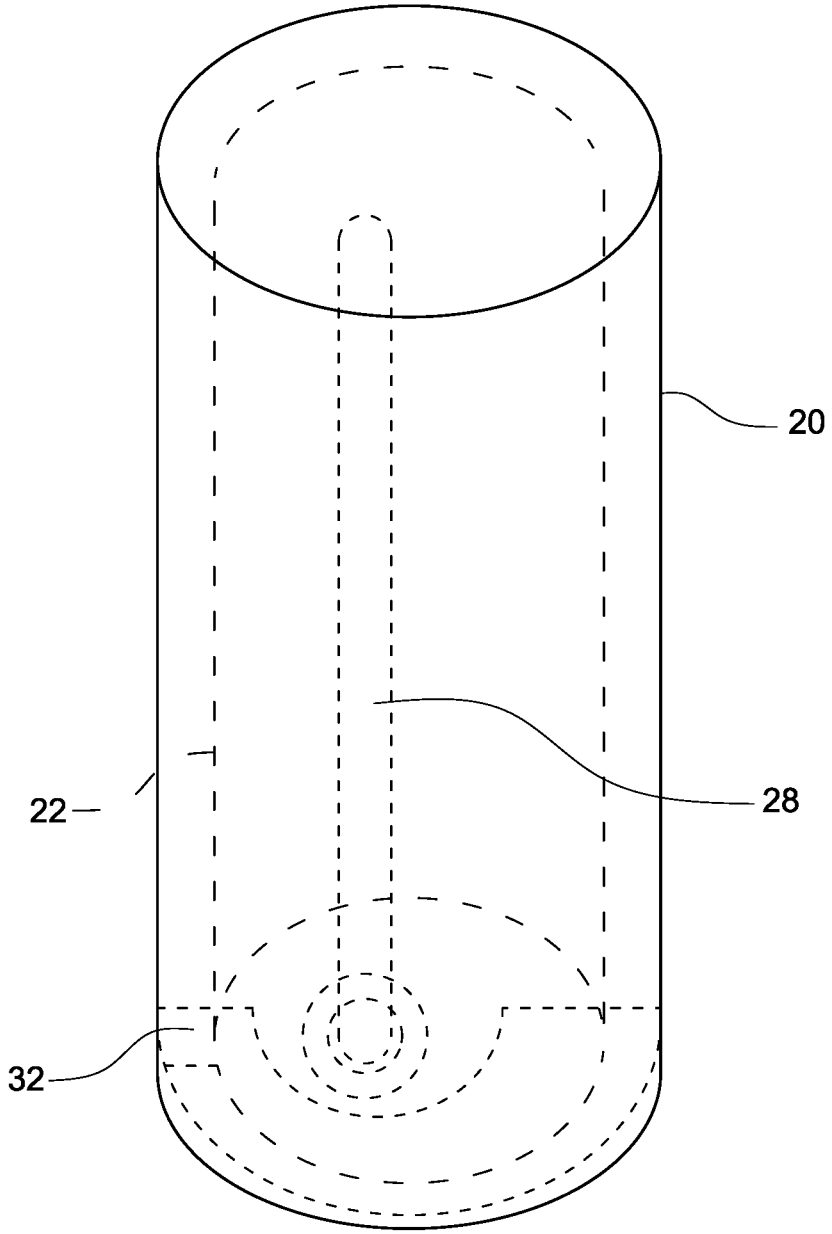
FIG. 1 shows the device of the invention positioned for use with a beverage container.

The present invention is directed to a method and apparatus for allowing rapid emptying of a beverage container, also known as shotgunning. The inventive apparatus, generally indicated by the numeral 10, is essentially a modified can insulating sleeve 20, the sleeve allowing for enhanced air and fluid flow to permit rapid emptying, or shotgunning of the can contents. The sleeve 20 is sized to slidably receive a standard sized 12 ounce can 22 with some frictional resistance to prevent unintended dislodgement of the can 22 as is known in the art. The sleeve 20 is made of any semi-rigid material with good insulating properties, but must be durable enough to prevent compression or deformation of the ventilating and dispensing openings as will be explained in more detail later. A semi-rigid plastic such as polyurethane or other foam insulation may be used, one of skill in the art can easily determine alternative materials based on the intended use of the device 10. When used as a can insulator, the can 22 is positioned within the sleeve 20 in the normal manner, with the top 23 of the can exposed so that the pour opening 24 can be accessed by the user to consume the beverage. A tubular cavity 25 is formed in the sleeve 20, the cavity sized for frictional engagement with a straw 28. The straw 28 is preferably made of a durable, rigid plastic to allow for cleaning and re-use as will be explained in more detail later. The straw 28 may be used just to consume the beverage in the conventional manner, but is not intended to be disposable. Accordingly, the straw 28 should have thick sidewalls relative to a disposable straw so it can be washed and reused for the life of the device.

Figure 2:
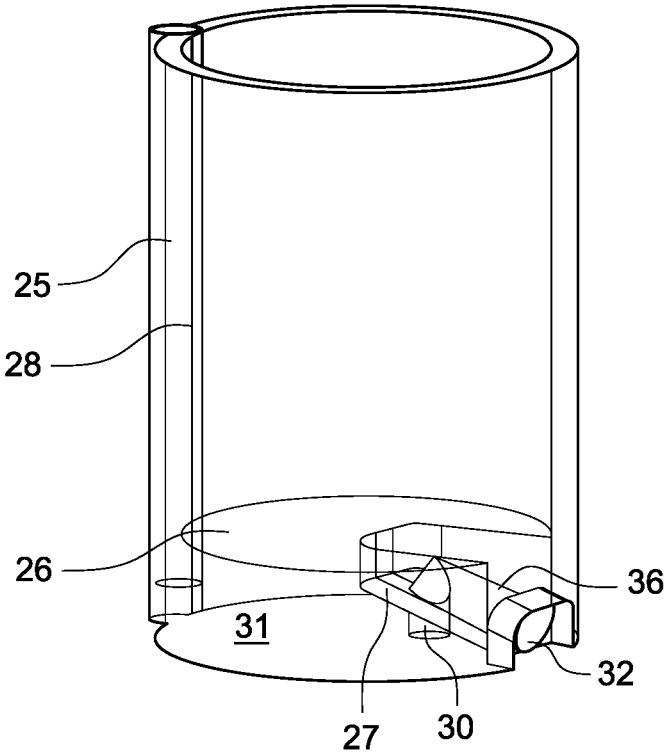
FIG. 2 shows a perspective view, partly in section, detailing the dispensing portion of the device.
Figure 3:
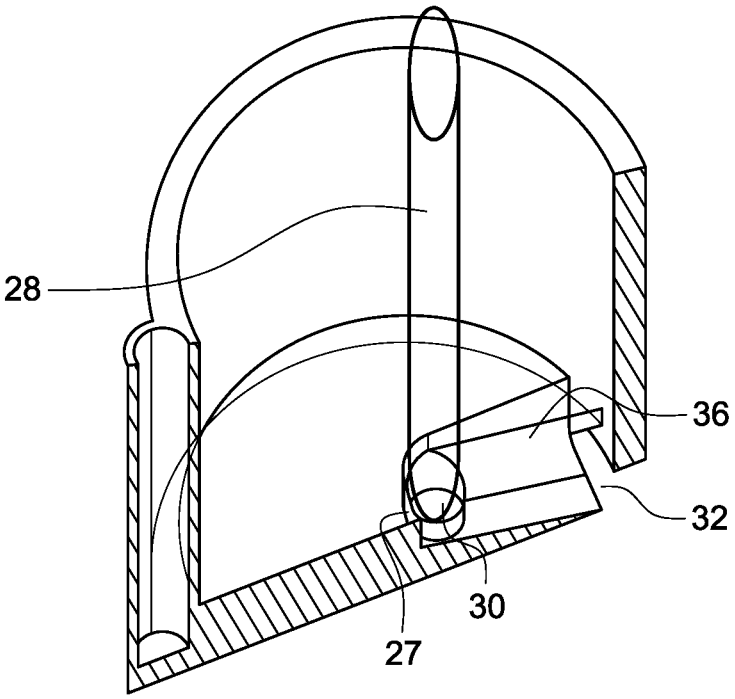
FIG. 3 shows a cross section of the dispensing end portion of the device.

In order to increase the flow rate of a liquid from a conventional can, an air intake or ventilation port must be formed to allow displacement air to replace the volume of the exiting liquid. Once formed, the intake port allows for air to enter the can 22 without perturbing outgoing fluid flow thereby effectively maximizing fluid flow for a given pour angle. Referring now particularly to FIGS. 2 and 3 it can be seen that the sleeve 20 has two openings formed in its base 26. A first opening 30 is formed in the closed end or base panel 31 of the sleeve, the opening 30 one end of a short tubular conduit 27 formed in the base 26. The other end 33 of the conduit allows for fluid (intake air) communication with the ambient atmosphere as will be explained in more detail later. This opening 30 essentially functions as the ventilating port to enable rapid pouring. A second opening 32 is formed in the lower sidewall 34 of the sleeve and functions as the pour opening, the second opening being one end of short conduit 36. The conduit 36 is generally perpendicular to conduit 27 and is gently sloped to encourage fluid flow.

Opening 30 is sized to allow for frictional fit of the straw 28 which serves as a displacement air conduit to conduct displacement air away from the pour opening 32.

Figure 4:
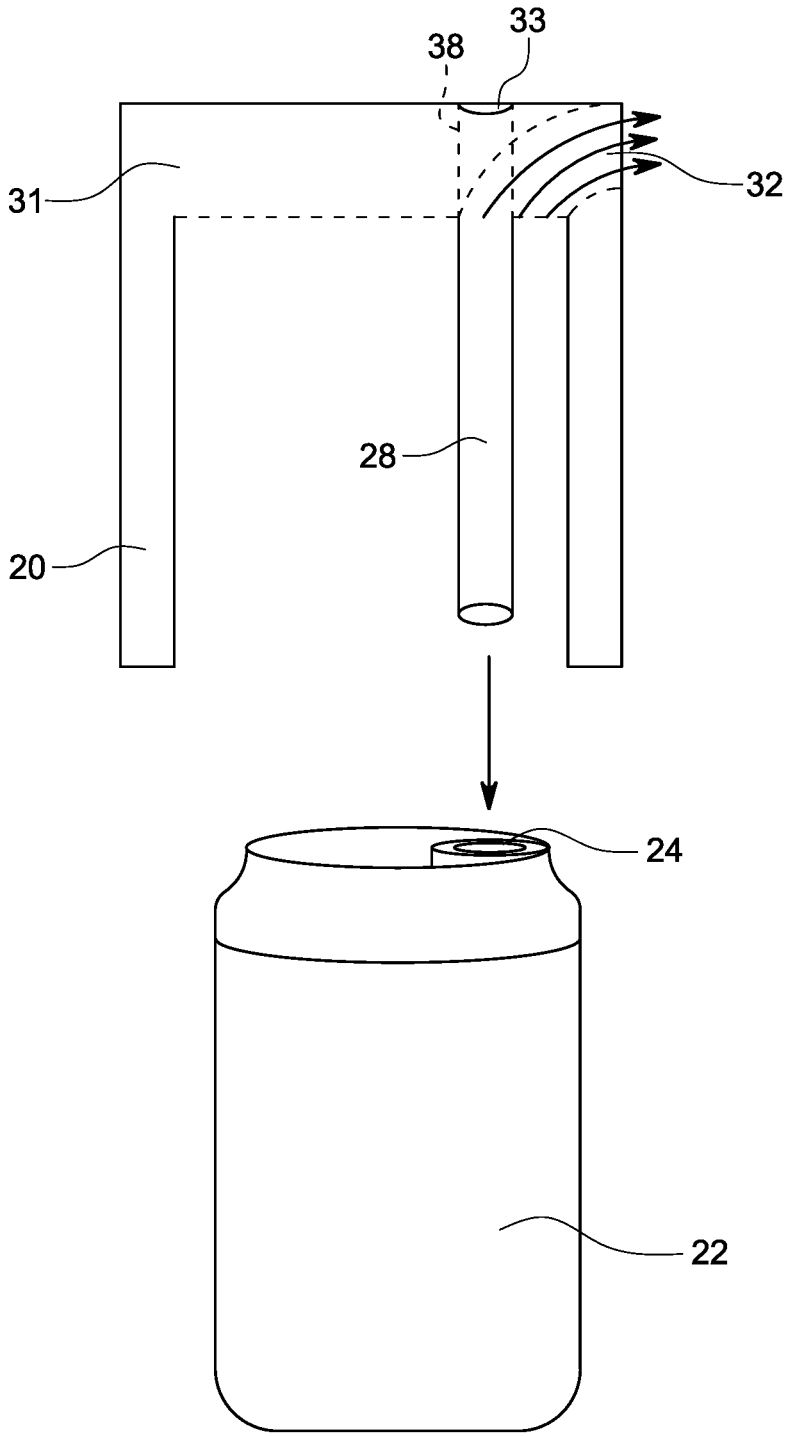
FIG. 4 shows a side view of the device prior to positioning on the beverage container.

In operation, the device 10 is converted from a can insulator to a rapid pour device by placing the sleeve 20 over the can 22 as shown in FIG. 4. Prior to positioning the sleeve 20 as shown in FIG. 4 the straw 28 is snugly secured within opening 30. The sleeve 20 is then inverted or rotated (to the "upside down" position, while the can 22 remains upright) so that the closed end or base panel 31 of the sleeve 20 is over the top of the can 22. The sleeve 20 is then slid over the can 20 with the straw 28 positioned to go into and through the original pour opening 24 of the can, which is opened prior to the procedure. One end of the straw 28 reaches nearly to the base panel 31 with the can 22 fully inserted into the sleeve 20, the opposing end 38 of the straw 28 now seated within the opening 30 to allow fluid communication with surrounding air. The device 10 may then be reoriented so that the base panel 31 is the lowermost part of the device 10, the device 10 now ready to pour. As the liquid is dispensed through opening 32, displacement air goes into and through the opening 32 and straw 28, where it displaces the liquid volume leaving the can 22. The straw 28 may be stored within sleeve 25 after use, and is not intended to be disposable as it is necessary for the device to function.

The invention claimed is:

1. A pour enhancing device for enabling rapid pour from a beverage can, said beverage can having a dispensing opening formed in an uppermost closure, said pour enhancing device comprising:

a generally cylindrical main body having sidewalls, and an open end and a closed end, with a generally cylindrical cavity formed in said sidewalls;

a straw removably inserted within said cavity;

said main body having a base and base panel forming said closed end, said base having a first conduit with opposing openings formed therein to allow airflow into said can, said straw sized for frictional fit within said first conduit;

said base also having a pour opening formed of one end of a second conduit, the second conduit generally perpendicular to the first conduit;

whereby, after inserting said straw within said first conduit, and inserting said can within an insulating sleeve of said device, liquid can be dispensed from said can from said pour opening while intake air can flow into said can through said first conduit, whereby enabling rapid pour.

2. The device of claim 1, wherein said straw is sized for frictional fit within said cavity.

3. The device of claim 1, wherein said main body is formed of an insulating material.

4. The device of claim 1, wherein said main body can be positioned on said can to provide thermal insulation.

* * * * *